US011131514B2

(12) United States Patent
Yin et al.

(10) Patent No.: US 11,131,514 B2
(45) Date of Patent: Sep. 28, 2021

(54) HEAT EXCHANGE DEVICE

(71) Applicant: Hangzhou Sanhua Research Institute Co., Ltd., Zhejiang (CN)

(72) Inventors: Yuting Yin, Zhejiang (CN); Jiang Zou, Zhejiang (CN); Rongrong Zhang, Zhejiang (CN)

(73) Assignee: Hangzhou Sanhua Research Institute Co., Ltd., Zhejiang (CN)

( * ) Notice: Subject to any disclaimer, the term of this patent is extended or adjusted under 35 U.S.C. 154(b) by 343 days.

(21) Appl. No.: 16/322,454

(22) PCT Filed: Aug. 1, 2017

(86) PCT No.: PCT/CN2017/095370

§ 371 (c)(1),
(2) Date: Jan. 31, 2019

(87) PCT Pub. No.: WO2018/024185

PCT Pub. Date: Feb. 8, 2018

(65) Prior Publication Data

US 2020/0309465 A1 Oct. 1, 2020

(30) Foreign Application Priority Data

Aug. 3, 2016 (CN) ..... 201610629325.5
Aug. 3, 2016 (CN) ..... 201610634384.1

(51) Int. Cl.
*F28F 9/02* (2006.01)
*F28D 7/16* (2006.01)
*F28F 9/00* (2006.01)

(52) U.S. Cl.
CPC ..... *F28F 9/0278* (2013.01); *F28D 7/1623* (2013.01); *F28D 7/1692* (2013.01);
(Continued)

(58) Field of Classification Search
CPC .... F28D 7/1692; F28D 7/1623; F28D 7/1661; F28D 7/163; F28D 7/1638; F28D 7/087;
(Continued)

(56) References Cited

U.S. PATENT DOCUMENTS 1,811,402 A * 6/1931 McNeal ..... F28D 7/1638 165/70
3,494,414 A * 2/1970 Warner ..... F28F 9/0241 165/82

(Continued)

FOREIGN PATENT DOCUMENTS

CN 1781009 A 5/2006
CN 201522209 U 7/2010

(Continued)

OTHER PUBLICATIONS

International Search Report and Written Opinion for International Application No. PCT/CN2017/095370, dated Oct. 26, 2017.

(Continued)

*Primary Examiner* — Devon Russell
(74) *Attorney, Agent, or Firm* — Wolf, Greenfield & Sacks, P.C.

(57) ABSTRACT

A heat exchange device includes a housing having an opening on one side, and a heat exchange core body. The heat exchange device also includes a connection block provided with a first channel, a second channel, a first interface, and a second interface. The connection block is also provided with a first socket of the first channel, and a first socket of the second channel. The heat exchange core body includes at least one flat tube. At least one part of one end of the flat tube extends into the first socket of the first channel and is mounted in a sealed manner with the first socket of the first channel, and at least one part of the other end of the flat tube extends into the first socket of the second (Continued)

channel and is mounted in a sealed manner with the first socket of the second channel.

16 Claims, 7 Drawing Sheets

(52) U.S. Cl.
CPC ..... *F28F 9/001* (2013.01); *F28F 9/0221* (2013.01); *F28F 9/0253* (2013.01); *F28F 2230/00* (2013.01)

(58) Field of Classification Search
CPC ..... F28F 9/001; F28F 9/0253; F28F 9/0131; F28F 2230/00
See application file for complete search history.

(56) References Cited

U.S. PATENT DOCUMENTS 4,415,024 A * 11/1983 Baker ..... F28D 7/1661 165/111
4,678,112 A 7/1987 Koisuka et al.
5,241,839 A * 9/1993 Hughes ..... B60H 1/3227 165/174
9,050,554 B2 * 6/2015 Janssens ..... F04F 1/18
10,054,368 B2 * 8/2018 Nishiyama ..... F28D 1/05375
2007/0131398 A1 * 6/2007 Ichiyanagi ..... F28F 9/0221 165/153
2007/0251682 A1 * 11/2007 Sasaki ..... F28F 9/0221 165/153
2011/0100585 A1 5/2011 Hohenstein et al.
2011/0209484 A1 * 9/2011 Krausch ..... F28D 1/0426 62/79
2014/0027099 A1 1/2014 Sispera et al.
2015/0260465 A1 * 9/2015 Busato ..... F28F 9/0133 165/80.1
2016/0091263 A1 * 3/2016 Yamaji ..... F28F 9/18 165/165
2017/0016677 A1 1/2017 Cheong et al.

FOREIGN PATENT DOCUMENTS

CN 102056464 A 5/2011
CN 106133467 A 11/2016
DE 10 2012 206 127 A1 10/2013
EP 0 947 792 A2 10/1999
EP 2 660 530 A1 11/2013

OTHER PUBLICATIONS

Extended European Search Report for European Application No. 17836367.7, dated Mar. 13, 2020.

* cited by examiner

HEAT EXCHANGE DEVICE

This application is a national stage filing under 35 U.S.C. § 371 of International Patent Application Serial No. PCT/CN2017/095370, filed Aug. 1, 2017, which claims the priorities to Chinese Patent Application No. 201610634384.1 titled "HEAT EXCHANGE DEVICE" and filed with the Chinese State Intellectual Property Office on Aug. 3, 2016, and Chinese Patent Application No. 201610629325.5 titled "HEAT EXCHANGE DEVICE" and filed with the Chinese State Intellectual Property Office on Aug. 3, 2016. The entire contents of these applications are incorporated herein by reference in their entirety.

FIELD

The present application relates to heat exchange apparatus and in particular to a heat exchange device.

BACKGROUND $CO_2$ is a new type of environment-friendly refrigerant which can reduce the global greenhouse effect and fundamentally solve the problem of compound pollution to the environment, and has good economy and practicability. A compression refrigeration cycle system with $CO_2$ as the working medium may be employed in most refrigeration/heating fields.

However, the working pressure of a $CO_2$ refrigeration system is high, which should be fully considered in designing a $CO_2$ heat exchange device. This type of system is not widely used since the design of the components of the system is still immature. In general, $CO_2$ heat exchange devices mainly include finned-tube type, microchannel type, plate type, shell-and-tube type, finned-plate type, double-pipe type and the like. Regarding the above types of $CO_2$ heat exchange devices, manufacturing processes of the plate type and finned-plate type are complicated, and tubes having large wall thicknesses are required for the finned-tube type, double-pipe type and shell-and-tube type, which causes material waste.

In addition, the conventional $CO_2$ microchannel heat exchange device exchanges heat through forced convection between the refrigerant and the air, which has low efficiency. Although physical properties of a liquid and the air are greatly different from each other, liquid-air heat exchange has high heat exchange efficiency. However, the liquid-air heat exchange devices in the conventional technology generally have large wall thicknesses of the flow pipes for bearing high pressures, and have a problem of poor heat exchange performance caused by uneven fluid distribution.

Therefore, a technical problem to be addressed is to provide a heat exchange device which is applicable in a relatively high-pressure refrigerant system and has good heat exchange performance.

SUMMARY

In order to solve the above technical problem, the following technical solution is provided according to the present application.

A heat exchange device, including a housing and a heat exchange core, wherein a chamber is formed in the housing, and the heat exchange core is partially or completely accommodated in the chamber. The housing is further provided with a third connecting port and a fourth connecting port, and the third connecting port and the fourth connecting port are in communication with the chamber. A first fluid channel is formed in the heat exchange core, and the first fluid channel is isolated from the chamber. The heat exchange device further includes a connecting block, the connecting block is provided with a first channel, a second channel, a first connecting port in communication with the first channel, and a second connecting port in communication with the second channel.

The connecting block is further provided with a first insertion hole of the first channel corresponding to the first channel, and a first insertion hole of the second channel corresponding to the second channel. The heat exchange core includes at least one flat tube, at least a part of the first fluid channel is located in the flat tube. At least a part of one end of the flat tube extends into the first insertion hole of the first channel and is mounted to the first insertion hole of the first channel in a sealed manner, and the first channel is in communication with the first fluid channel; at least a part of another end of the flat tube extends into the first insertion hole of the second channel and is mounted to the first insertion hole of the second channel in a sealed manner, and the second channel is in communication with the first fluid channel.

Compared with the conventional technology, the heat exchange device according to the present application is simple in manufacture and installation, has a light weight, low cost, and has good pressure resistance performance and heat exchange performance.

DETAILED DESCRIPTION OF EMBODIMENTS

Specific embodiments of the present application will be illustrated hereinafter in conjunction with accompanying drawings.

Figure 1:
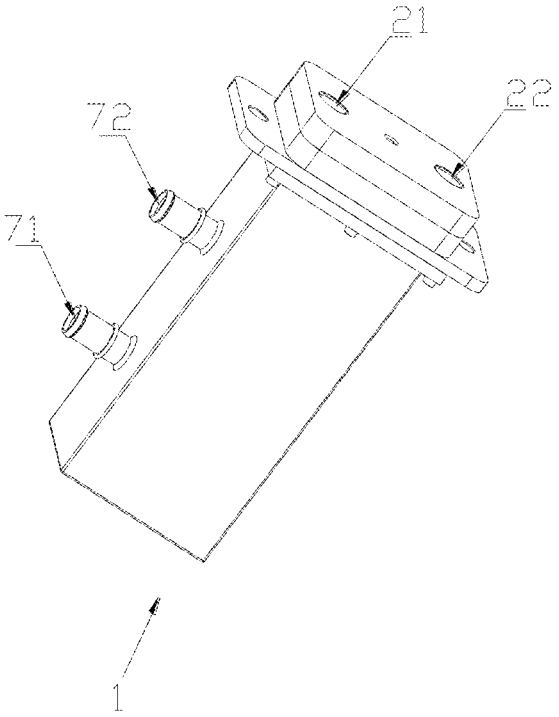
FIG. 1 is a schematic perspective view showing the structure of a heat exchange device according to an embodiment of the present application.
Figure 2:
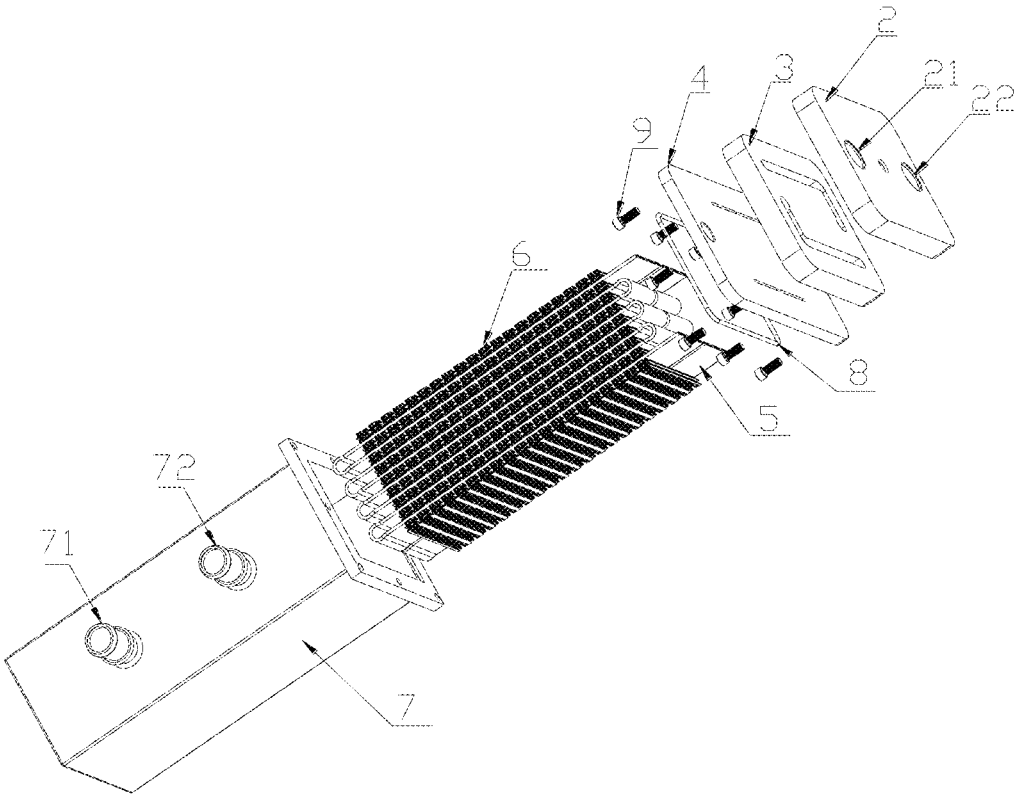
FIG. 2 is a schematic exploded view showing the structure of the heat exchange device shown in FIG. 1.

FIG. 1 is a schematic perspective view showing a heat exchange device according to an embodiment of the present application, and FIG. 2 is a schematic exploded view of the heat exchange device shown in FIG. 1. As shown in the figures, the heat exchange device 1 according to this embodiment includes a housing 7 having an open side, a first connecting block 2, a second connecting block 3, a mounting plate 4, and a heat exchange core partially or completely accommodated in the housing 7. The mounting plate 4 is fixedly mounted to the open side of the housing 7 and covers an opening of the housing. A first fluid channel is formed in the heat exchange core.

The heat exchange core includes at least one flat tube 5, in this embodiment, the heat exchange core includes two flat tubes arranged in parallel. A plurality of tiny fluid channels are formed in each of the flat tubes 5, and the first fluid channel includes the plurality of tiny fluid channels. The heat exchange device 1 is further provided with a first connecting port 21 and a second connecting port 22, and the first connecting port 21 and the second connecting port 22 are located at the first connecting block 2. Two ends of the flat tube 5 communicate with the first connecting port 21 and the second connecting port 22 respectively, such that the first fluid channel is in communication with the first connecting port 21 and the second connecting port 22, respectively. The housing 7 is further provided with a third connecting port 71 and a fourth connecting port 72, a chamber is formed in the housing, the heat exchange core is partially or completely accommodated in the chamber, the third connecting port and the fourth connecting port are in communication with the chamber, and the first fluid channel is isolated from the chamber.

Figure 3:
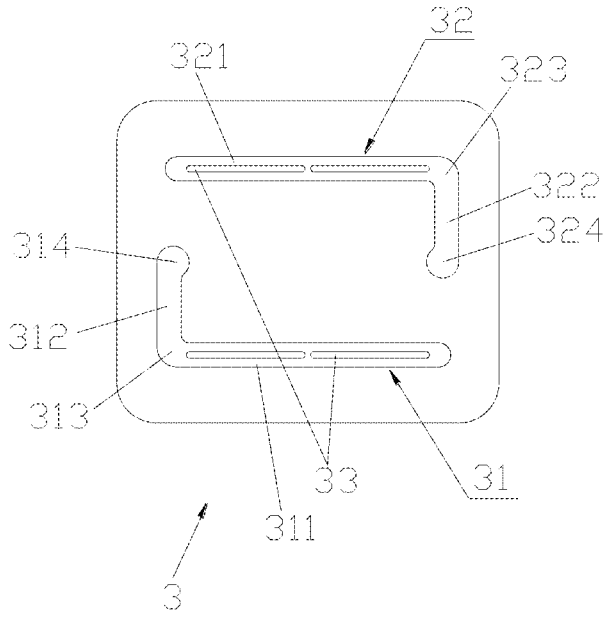
FIG. 3 is a schematic view showing the structure of a second connecting block of the heat exchange device shown in FIG. 1.

As shown in FIG. 3, the second connecting block 3 is provided with a first channel 31 and a second channel 32, and the first channel 31 and the second channel 32 are recessed at a side of the second connecting block 3 facing the first connecting block 2. The first channel 31 includes a first straight channel 311, a second straight channel 312, a bending portion 313 between the first straight channel 311 and the second straight channel 312, and a bubble-like end portion 314 located at an end of the second straight channel 312 away from the bending portion 313. The second channel 32 also includes a first straight channel 321, a second straight channel 322, a bending portion 323 between the first straight channel 321 and the second straight channel 322, and a bubble-like end portion 324 at an end of the second straight channel 322 away from the bending portion 323. The second connecting block 3 is further provided with first insertion holes 33 of the first channel corresponding to the first straight channel 311 of the first channel 31 and first insertion holes 33 of the second channel corresponding to the first straight channel 321 of the second channel 32. The flat tubes 5 are in a clearance fit with the first insertion holes 33, one end of each of the flat tubes 5 passes through a corresponding first insertion hole 33 of the second channel 32, and another end of the flat tube 5 passes through a corresponding first insertion hole 33 of the first channel 31. The flat tube 5 may be fixedly mounted to the first insertion holes 33 by welding or the like. At least a part of the end of the flat tube extending into the first insertion hole of the first channel extends into the first straight channel of the first channel or communicates with the first straight channel of the first channel, and at least a part of the end of the flat tube extending into the first insertion hole of the second channel extends into the first straight channel of the second channel or communicates with the first straight channel of the second channel. In order to ensure the mounting stability between the flat tube 5 and the first insertion holes 33, a depth of each of the first insertion holes is greater than or equal to 2 mm. It should be noted that, clearances between the flat tube 5 and the first insertion holes 33 can be filled with a molten solder during welding, so that the flat tube 5 is mounted to the first insertion holes 33 in a sealed manner.

Inner diameters or equivalent inner diameters of the bubble-like end portions 314 and 324 are larger than widths of the second straight channels 312 and 322, respectively. The bubble-like end portion 314 of the first channel 31 corresponds to the first connecting port 21, and an inner diameter or equivalent inner diameter of the bubble-like end portion 314 of the first channel 31 is substantially greater than or equal to an inner diameter or equivalent inner diameter of a portion of the first connecting port 21 close to the bubble-like end portion 314 of the first channel 31; and, the bubble-like end portion 324 of the second channel 32 corresponds to the second connecting port 22, and an inner diameter or equivalent inner diameter of the bubble-like end portion 324 of the second channel 32 is substantially greater than or equal to an inner diameter or equivalent inner diameter of a portion of the second connecting port 22 close to the bubble-like end portion 324 of the second channel 32. In this way, local sudden-shrink resistance generated when a fluid flows from the first connecting port 21 to the second straight channel 312 of the first channel 31 and flows from the second straight channel 322 of the second channel 32 to the second connecting port 22 can be effectively reduced, and thereby pressure drop losses of the fluid can be effectively reduced.

The second straight channel 312 and the bending portion 313 are provided in the first channel 31, and a distance is kept between the bending portion 313 of the first channel 31 and the first insertion holes 33 of the first channel 31. In this way, the fluid first flows from the first connecting port 21 and then flows into the tiny fluid channels in the flat tubes 5 through the second straight channel 312 and the bending portion 313 in sequence, so that the fluid does not directly rush toward the flat tubes 5 when flowing from the first connecting port 21, which alleviates the problem of uneven fluid distribution in the tiny fluid channels of the flat tubes 5, and thereby improving the heat exchange performance of the heat exchange device.

Similarly, the second straight channel 322 and the bending portion 32 are provided in the second channel 32, and a distance is kept between the bending portion 323 of the second channel 32 and the first insertion holes 33 of the second channel 32. In this way, the fluid first flows through the bending portion 323 and the first insertion holes 33 and then flows to the second connecting port 22, so that flow resistance generated when the fluid flows from each of the tiny fluid channels of the flat tubes 5 to the second channel 32 is substantially the same, which alleviates the problem of uneven fluid distribution in the tiny fluid channels of the flat tubes 5, and thereby improving the heat exchange performance of the heat exchange device.

Besides, the first connecting port 21 is arranged corresponding to the bubble-like end portion 314 of the first channel 31, and the second connecting port 22 is arranged corresponding to the bubble-like end portion 324 of the second channel 32, in this way, the first channel 31 and the second channel 32 can be flexibly arranged according to positions of the first connecting port 21 and the second connecting port 22, so that the heat exchange device can be applicable in more complicated installation environments.

Figure 4:
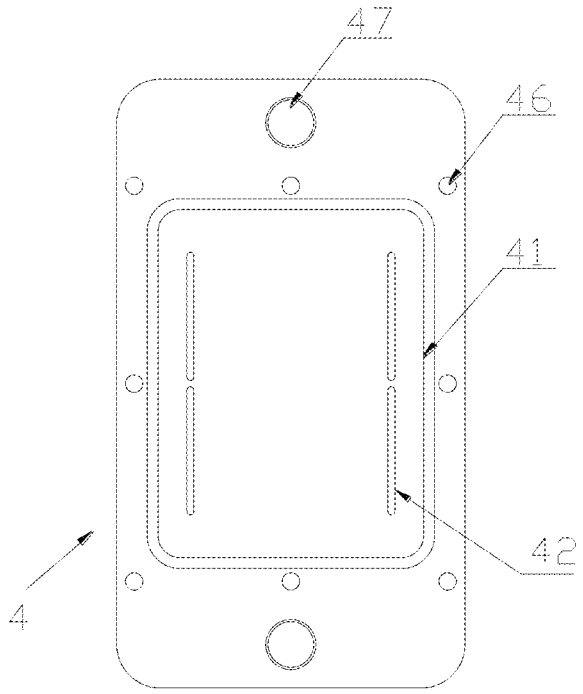
FIG. 4 is a schematic view showing the structure of a mounting plate of the heat exchange device shown in FIG. 1.

As shown in FIGS. 2 and 4, the mounting plate 4 is provided with second insertion holes 42 running through the mounting plate 4, the flat tubes 5 are in a clearance fit with the second insertion holes 42, ends of the flat tubes 5 may pass through the second insertion holes 42 respectively, and the flat tubes 5 may be fixedly mounted to the second insertion holes 42 by welding or the like. The mounting plate 4 and the second connecting block 3 may be fixed to each other in a seal manner by welding or the like. The first insertion holes 33 correspond to the second insertion holes 42 respectively, and the flat tube 5 passes through the corresponding second insertion holes 42 and first insertion holes 33 in sequence. Similarly, a depth of each of the second insertion holes 42 is greater than or equal to 2 mm.

The mounting plate 4 covers the open side of the housing 7. In order to improve the sealing performance, a sealing member 8 is further arranged between the mounting plate 4 and the housing 7, a sealing member groove 41 for mounting the sealing member and screw holes 46 are arranged at a portion of the mounting plate 4 that is in contact with the housing 7, and the mounting plate 4 may be fixedly mounted to the housing 7 by screws. The mounting plate 4 is further provided with mounting holes 47 for mounting the heat exchange device.

It should be noted that, the mounting plate may be integrated with the connecting block; or, the connecting block may further has the function of the mounting plate, in this case, the connecting block is further provided with the sealing member groove and the screw holes, and in this embodiment, the second insertion holes are not required. Of course, the mounting plate may also be arranged at other positions of the housing or be fixed to other parts of the housing, to function to fix the heat exchange device.

Figure 5:
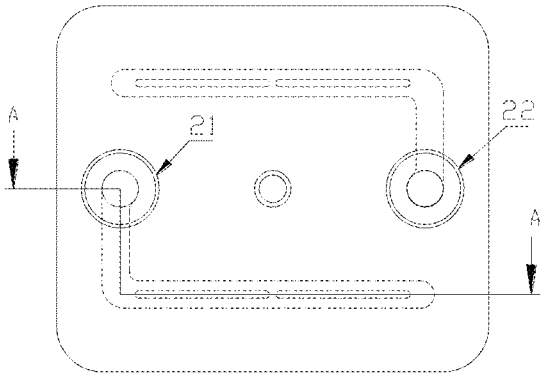
FIG. 5 is a schematic view showing a combination of a first mounting plate and a second mounting plate of the heat exchange device shown in FIG. 1.
Figure 6:
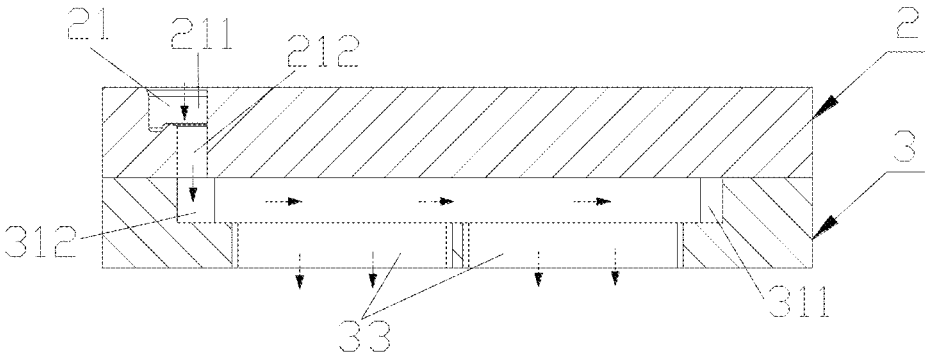
FIG. 6 is a schematic sectional view taken along line A-A shown in FIG. 5.

As shown in FIGS. 5 and 6, the first connecting port 21 and the second connecting port 22 of the first connecting block 2 run through the first connecting block 2, and the first connecting port 21 and the second connecting port 22 are stepped holes each including a small-diameter portion close to the second connecting block 3 and a large-diameter portion away from the second connecting block 3. As shown in FIG. 6, the first connecting port 21 includes a large-diameter portion 211 and a small-diameter portion 212, where the small-diameter portion 212 corresponds to the bubble-like end portion 314 of the first channel 31, and an inner diameter or equivalent inner diameter of the small-diameter portion 212 is substantially or exactly the same as the inner diameter or equivalent inner diameter of the bubble-like end portion 314 of the first channel 31. It should be noted that, the first channel 31 and the second channel 32 may also be arranged at a side portion of the first connecting block 2 that is in contact with the second connecting block 3. In this embodiment, by assembling the first connecting block 2, the second connecting block 3 and the mounting plate 4 in this manner, on the one hand, each component has relatively less processing procedures and is simple to process, on the other hand, materials may be saved (for example, a thickness of the mounting plate may be relatively small), thereby reducing the costs.

In this embodiment, by providing sealed channels in the first connecting block and/or the second connecting block, not only the channels have high pressure resistance performance and are not prone to deform under high pressures, but also the structures are simple, the processing is convenient, and the costs are low.

Figure 7:
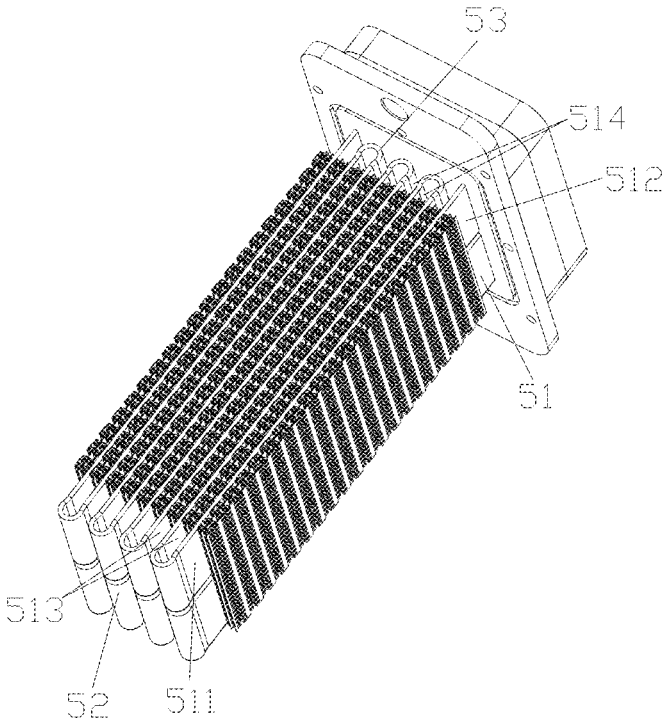
FIG. 7 is a schematic perspective view showing the structure of the heat exchange device shown in FIG. 1 after a housing is removed.

As shown in FIG. 7, two ends of the flat tube, after the flat tube is bent for several times, pass through the first insertion holes 33 and the second insertion holes 42 and then extend into the first channel 31 and the second channel 32, such that the first connecting port 21 is in communication with the second connecting port 22 through the first fluid channel.

Multiple straight portions 51, multiple first bending portions 52, and multiple second bending portions 53 are formed by bending the flat tube 5, where the first bending portions 52 are away from the mounting plate 4, the second bending portions 53 are close to the mounting plate 4, and the multiple straight portions 51 are substantially parallel to each other. A certain distance is kept between two adjacent straight portions 51, and the distance between two adjacent straight portions 51 ranges from 0.5 mm to 6 mm. Fins 6 are further arranged between two adjacent straight portions 51, and the fins 6 are mostly located in a space between the two adjacent straight portions 51. The fins 6 may be zigzag fins, or may be other forms of fins, such as dimple plates, twisted strips, perforated fins, spiral coils, and straight fins, etc. The fins 6 arranged between two adjacent straight portions 51 can improve the flow disturbing performance of the fluid, thereby improving the heat exchange performance of the heat exchange device. At each of ends close to a corresponding first bending portion 52, the fins are spaced apart from the first bending portion 52 by a certain distance, that is, each of the straight portions 51 includes a first finless region 511 where no fin is provided, which is located at the end close to the first bending portion 52. A first through-flow region 513 is formed between two adjacent first finless regions 511 or between a first finless region 511 and an inner wall, and at the end close to the first bending portion 52, the distance between the fins and the first bending portion 52 ranges from 5 mm to 30 mm. Since no fin is provided at a portion of an end of the straight portion 51 close to the first bending portion 52, the flow resistance of the fluid in the first through-flow region 513 between two adjacent straight portions is small. The fluid may first flow in a width direction of the flat tube 5 located at the first bending portion 52 and the first through-flow region 513, and the fluid in a space between any set of adjacent straight portions may be substantially distributed uniformly in the space or in the width direction of the flat tube. Then the fluid flows in a length direction of the straight portion 51 between the adjacent flat tubes, so that the fluid can be uniformly distributed in the width direction and length direction of the flat tube, thereby improving the heat exchange performance of the heat exchange device.

Similarly, at each of ends close to a corresponding second bending portion 53, the fins are spaced apart from the second bending portion 53 by a certain distance, that is, each of the straight portions 51 further includes a second finless region 512 where no fin is provided, which is located at the end close to the second bending portion 53. A second through-flow region 514 is formed between two adjacent second finless regions 512 or between a second finless region 512 and the inner wall, and at the end close to the second bending portion 53, the distance between the fins and the second bending portion 53 ranges from 5 mm to 30 mm. Since no fin is provided at a portion of an end of the straight portion 51 close to the second bending portion 53, flow paths of the fluid in length directions of the straight portions provided with the fins 6 are substantially the same, and the flow resistance of the fluid flowing in the length directions of the straight portions provided with the fins 6 is substantially the same, which is favorable for the uniform distribution of the fluid, thereby improving the heat exchange performance.

Each fin 6 is provided with a composite layer, and the fins 6 and the flat tube 5 may be fixed together by brazing or the like.

Figure 8:
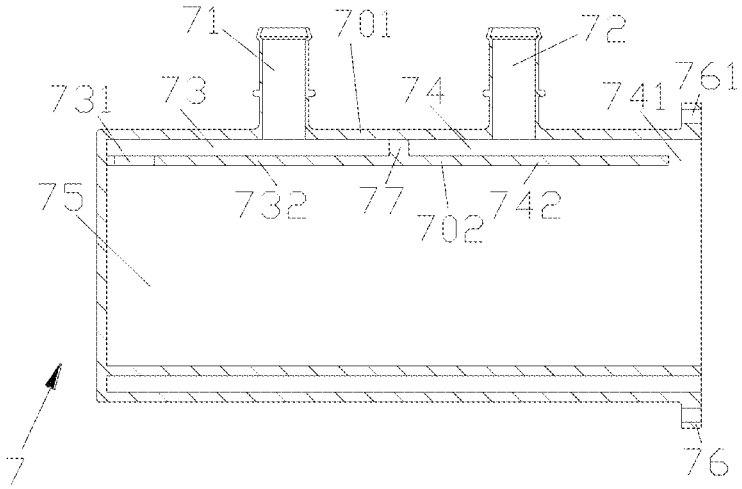
FIG. 8 is a schematic sectional view of the housing of the heat exchange device shown in FIG. 1.
Figure 9:
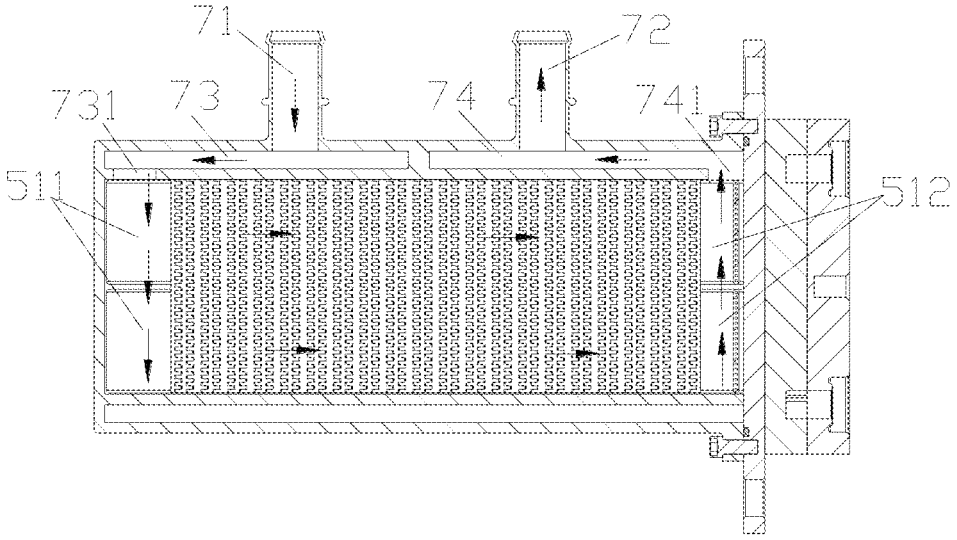
FIG. 9 is a schematic sectional view taken through a third connecting port and a fourth connecting port of the heat exchange device shown in FIG. 1.
Figure 10:
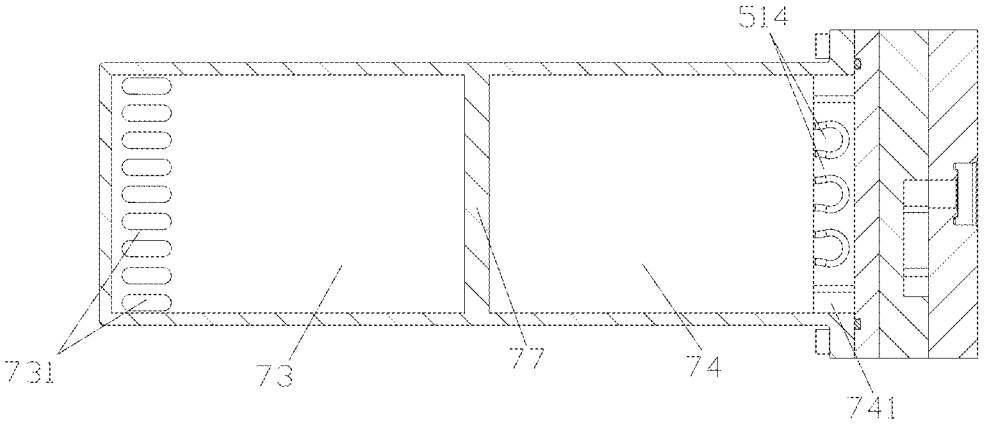
FIG. 10 is a schematic sectional view taken through a first chamber and a second chamber of the heat exchange device shown in FIG. 1.
Figure 11:
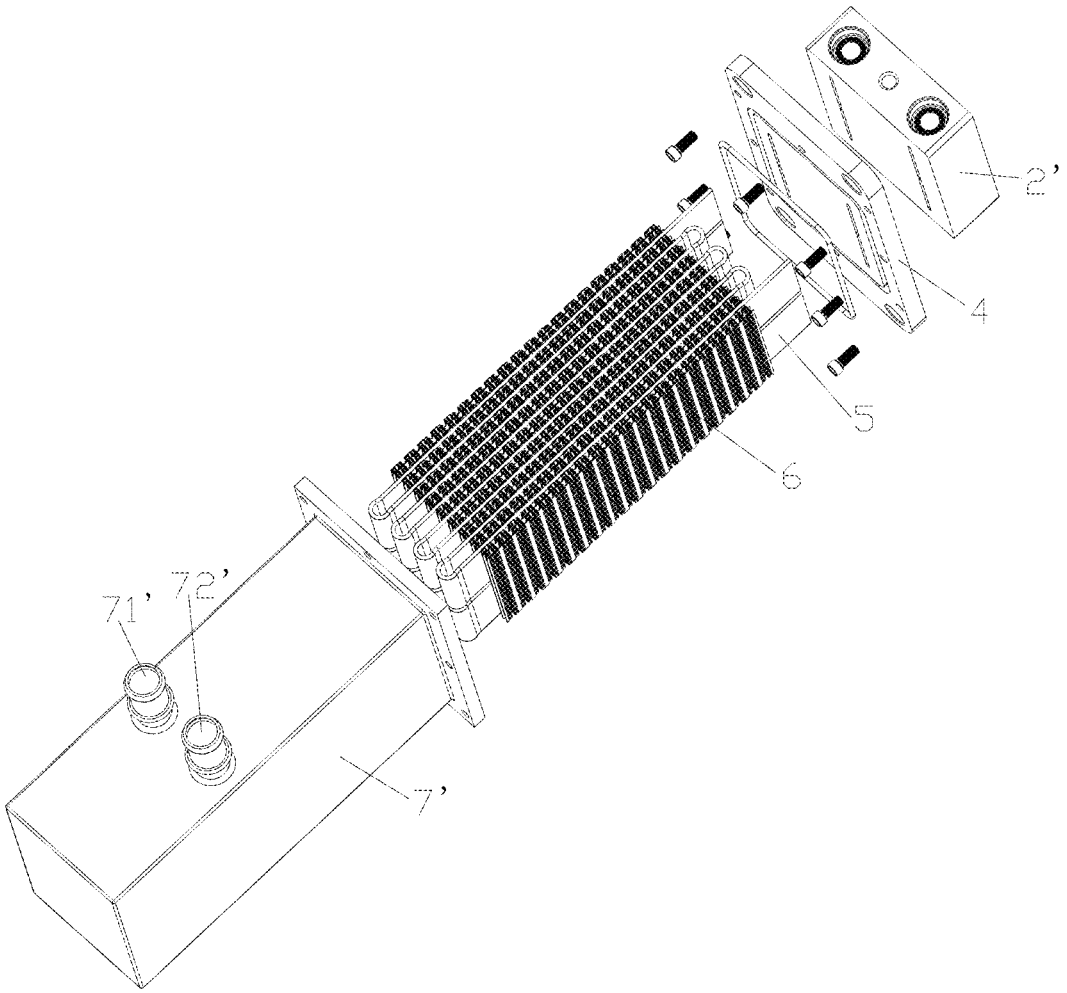
FIG. 11 is a schematic exploded view showing the structure of a heat exchange device according to another embodiment of the present application.
Figure 12:
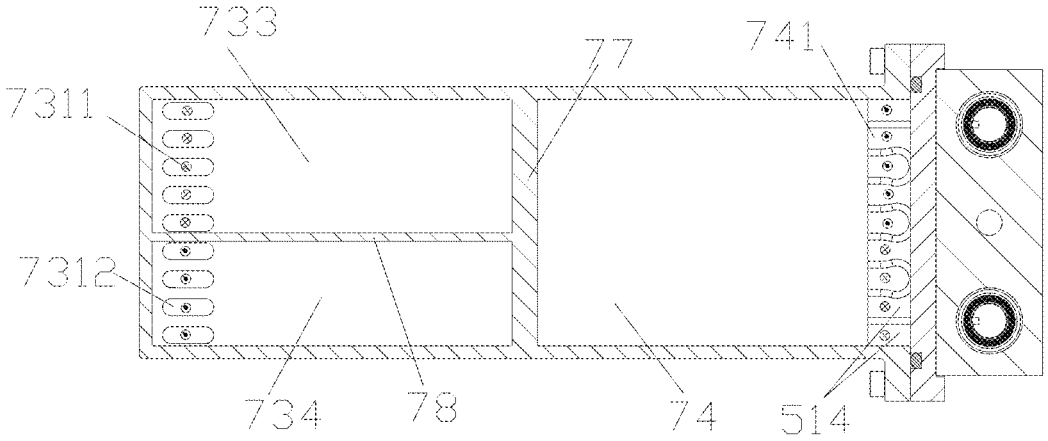
FIG. 12 is a schematic sectional view of the heat exchange device shown in FIG. 11.

In this embodiment, the housing 7 includes an outer housing 701 and a partition member 702. Both the outer housing 701 and the partition member 702 may be an integrally formed injection molding piece or an integrally formed casting piece, which may be integrally formed by a material chosen according to properties of the fluid in the first fluid channel and the application environment. As shown in FIGS. 8 to 10, the partition member 702 is arranged in the outer housing 701. A first chamber 73, a second chamber 74 and a third chamber 75 are formed in the housing 7, where the first chamber 73 is in communication with the third connecting port 71, and the second chamber 74 is in communication with the fourth connecting port 72. The partition member 702 includes a first partition wall 77, a first wall portion 732 and a second wall portion 742, where the first partition wall 77 is arranged between the first chamber 73 and the second chamber 74, and the first chamber 73 is not in direct communication with the second chamber 74. Moreover, one end of the second chamber 74 is open, one end of the third chamber 75 is open, and an opening of the second chamber 74 and an opening of the third chamber 75 faces a same direction.

The first wall portion 732 is arranged between the first chamber 73 and the third chamber 75, and the second wall portion 742 is arranged between the second chamber 74 and the third chamber 75. The first wall portion 732 corresponding to the third connecting port 71 is provided with a first communication hole 731, and the first chamber 73 communicates with the third chamber 75 through the first communication hole 731; and, the second wall portion 742 corresponding to the fourth connecting port 72 is provided with a second communication hole 741, and the second chamber 74 communicates with the third chamber 75 through the second communication hole 741.

A projection of the third connecting port 71 on the first wall portion 732 does not interfere with the first communication hole 731, and a projection of the fourth connecting port 72 on the second wall portion 742 does not interfere with the second communication hole 741. A projection of the first finless regions 511 on the first wall portion 732 partially or completely overlaps with the first communication hole 731, and a projection of the fins 6 on the first wall portion 732 does not overlaps with the first communication hole 731. A projection of the second finless regions 512 on the second wall portion 742 partially or completely overlaps with the second communication hole 741, and a projection of the fins 6 on the second wall portion 742 does not overlaps with the second communication hole 741.

Moreover, the first communication hole 731 includes a plurality of small communication holes having small path sizes, and each of the small communication holes corresponds to at least one first through-flow region 513, that is, a projection of each of the first through-flow regions 513 on the first wall portion 732 is located at a small communication hole. As shown by the arrows in FIG. 9, in a case that the third connecting port 71 functions as an inlet for a first fluid, the first fluid flows into the first chamber 73 from the third connecting port 71, then uniformly flows into the first through-flow regions 513 through the small communication holes, then flows into the second chamber 74 through the fins 6 and the second through-flow regions 514, and then flows out of the heat exchange device through the fourth connecting port 72. Such arrangement is favorable for improving the heat exchange performance of the heat exchange device.

Apparently, the second communication hole 741 may also be provided with a plurality of small communication holes having small path sizes.

An outwardly extending portion 76 is provided at the open side of the housing 7, the outwardly extending portion 76 is provided with multiple screw holes 761, and the screw holes 761 of the outwardly extending portion cooperate with the screw holes 46 of the mounting plate. The housing 7 and the mounting plate 4 are fixedly assembled by the screws 9 and sealed by the sealing member 8.

FIGS. 11 to 14 show another embodiment of the present application. One difference between this embodiment and the above embodiment is that in this embodiment, the partition member 702 further includes a second partition wall 78, and the first chamber 73 is divided into two sub-chambers by the second partition wall 78, that is, a first sub-chamber 733 and a second sub-chamber 734. The first sub-chamber 733 is in communication with a third connecting port 71', and the second sub-chamber 734 is in communication with a fourth connecting port 72'. Similarly, the first communication hole 731 is also divided into two sub-communication holes by the second partition wall 78, that is, a first sub-communication hole 7311 and a second sub-communication hole 7312. Similarly, the first sub-communication hole 7311 and/or the second sub-communication hole 7312 may also include multiple small communication holes having small path sizes.

After flowing from the first connecting port 71' into the first sub-chamber 733, the fluid flows through the first sub-communication hole 7311 into a part of the first through-flow regions 513, then flows through the fins 6 to a part of the second through-flow regions 514, then flows through the second communication hole and the second chamber 74 to another part of the second through-flow regions 514, then flows through the fins 6 and another part of the first through-flow regions 513, then flows through the second sub-communication hole 7312 into the second sub-chamber 734, and then flows out of the heat exchange device through the fourth connecting port 72'. With such arrangement, a flow path of the first fluid can be increased, so that the heat exchange of the first fluid may be more fully, thereby improving the heat exchange performance of the heat exchange device. Moreover, under the same heat exchange performance, the present heat exchange device may have a smaller size which decreases the size of the heat exchange device, and miniaturizes the heat exchange device.

Figure 13:
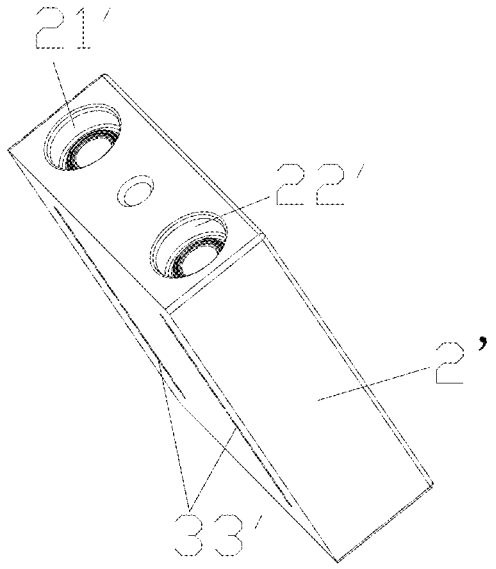
FIG. 13 is a schematic perspective view showing the structure of a connecting block of the heat exchange device shown in FIG. 11.
Figure 14:
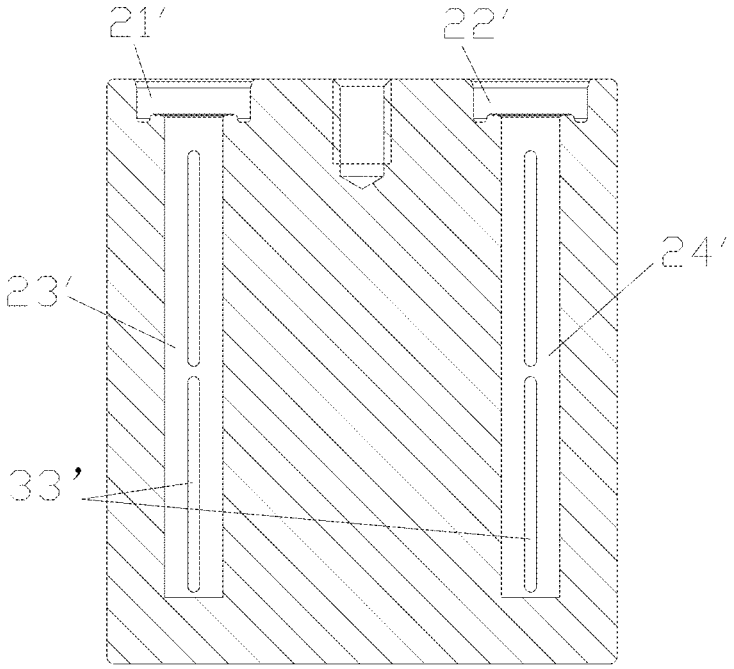
FIG. 14 is a schematic sectional view of the connecting block shown in FIG. 13.

Another difference between this embodiment and the above embodiment is that in this embodiment, the heat exchange device includes only one connecting block 2'. As shown in FIGS. 13 and 14, the connecting block 2' is provided with a first channel 23' and a second channel 24'. The connecting block 2' is further provided with a first connecting port 21' communicating with the first channel 23', and a second connecting port 22' communicating with the second channel 24'. Extending directions of the first connecting port 21' and the second connecting port 22' are the same as longitudinal directions of the first channel 23' and the second channel 24'. An inner diameter or equivalent inner diameter of the first connecting port is larger than an inner diameter or equivalent inner diameter of the first channel, and a step is formed between the first connecting port and the first channel; and, an inner diameter or equivalent inner diameter of the second connecting port is larger than an inner diameter or equivalent inner diameter of the second channel, and a step is formed between the second connecting port and the second channel. First insertion holes 33' communicating with the first channel 23' and the second channel 24' are arranged at a wall portion of the connecting block 2' facing the mounting plate 4. The first connecting port 21' extends inwardly and does not intersect or interfere with the first insertion holes 33' of the first channel 23', and the second connecting port 22' extends inwardly and does not intersect or interfere with the first insertion holes 33' of the second channel 24'. With such arrangement, the manufacture is simple and an integration level is high, which can reduce the welding difficulty and increase the reliability of the product.

It should be noted that, there may be only one of the two differences exist in this embodiment, and other parts of this embodiment may be the same as or similar to the above embodiment. In order to facilitate the illustration, the two differences are placed in one embodiment herein.

Other structures and features of this embodiment are the same as or similar to those of the above embodiment, which will not be described herein again.

The embodiments described hereinabove are only specific embodiments of the present application, and are not intended to limit the scope of the present application in any form. Although the present application is disclosed by the above preferred embodiments, the preferred embodiments should not be interpreted as a limitation to the present application. For those skilled in the art, many variations, modifications or equivalent replacements may be made to the technical solutions of the present application by using the methods and technical contents disclosed hereinabove, without departing from the scope of the technical solutions of the present application. Therefore, any simple modifications, equivalent replacements and modifications, made to the above embodiments based on the technical essences of the present application without departing from the technical solutions of the present application, are deemed to fall into the scope of the technical solution of the present application.

The invention claimed is:

1. A heat exchange device, comprising a housing and a heat exchange core, wherein a chamber is formed in the housing, the heat exchange core is partially or completely accommodated in the chamber, the housing is further provided with a third connecting port and a fourth connecting port, and the third connecting port and the fourth connecting port are in communication with the chamber;

a first fluid channel is formed in the heat exchange core, and the first fluid channel is isolated from the chamber; and wherein the heat exchange device is further provided with a connecting block, the connecting block is provided with a first channel, a second channel, a first connecting port in communication with the first channel, and a second connecting port in communication with the second channel;

the connecting block is further provided with a first insertion hole of the first channel corresponding to the first channel and a first insertion hole of the second channel corresponding to the second channel; and the heat exchange core comprises at least one flat tube, at least a part of the first fluid channel is located in the at least one flat tube; at least a part of one end of the at least one flat tube extends into the first insertion hole of the first channel and is mounted to the first insertion hole of the first channel in a sealed manner, and the first channel is in communication with the first fluid channel of the at least one flat tube; and, at least a part of another end of the at least one flat tube extends into the first insertion hole of the second channel and is mounted to the first insertion hole of the second channel in a sealed manner, and the second channel is in communication with the first fluid channel of the at least one flat tube;

an extending direction of the first connecting port is the same as a longitudinal direction of the first channel, an inner diameter or equivalent inner diameter of the first connecting port is greater than an inner diameter or equivalent inner diameter of the first channel, and a step is formed between the first connecting port and the first channel; and an extending direction of the second connecting port is the same as a longitudinal direction of the second channel, an inner diameter or equivalent inner diameter of the second connecting port is greater than an inner diameter or equivalent inner diameter of the second channel, and a step is formed between the second connecting port and the second channel.

2. The heat exchange device according to claim 1, wherein the connecting block comprises a first connecting block and a second connecting block, the first connecting port and the second connecting port are arranged at the first connecting block;

the first channel and the second channel are recessed at a side of the second connecting block facing the first connecting block; the first channel comprises a first straight channel, a second straight channel, and a bending portion between the first straight channel and the second straight channel; the second channel also comprises a first straight channel, a second straight channel, and a bending portion between the first straight channel and the second straight channel;

at least a part of the end of the at least one flat tube extending into the first insertion hole of the first channel is configured to extend into the first straight channel of the first channel or in communication with the first straight channel of the first channel, and at least a part of the end of the at least one flat tube extending into the first insertion hole of the second channel is configured to extend into the first straight channel of the second channel or in communication with the first straight channel of the second channel; and a depth of each of the first insertion holes is greater than or equal to 2 mm.

3. The heat exchange device according to claim 2, wherein the first channel further comprises a cylindrical end portion, the cylindrical end portion is located at an end of the second straight channel of the first channel away from the bending portion of the first channel, and the second channel further comprises a cylindrical end portion located at an end of the second straight channel of the second channel away from the bending portion of the second channel; and an inner diameter or equivalent inner diameter of the cylindrical end portion of the first channel is greater than a path size of the second straight channel of the first channel, and an inner diameter or equivalent inner diameter of the cylindrical end portion of the second channel is greater than a path size of the second straight channel of the second channel.

4. The heat exchange device according to claim 3, wherein the cylindrical end portion of the first channel corresponds to the first connecting port, and the cylindrical end portion of the second channel corresponds to the second connecting port; and the inner diameter or equivalent inner diameter of the cylindrical end portion of the first channel is greater than or equal to an inner diameter or equivalent inner diameter of a portion of the first connecting port close to the cylindrical end portion of the first channel, and the inner diameter or equivalent inner diameter of the cylindrical end portion of the second channel is greater than or equal to an inner diameter or equivalent inner diameter of a portion of the second connecting port close to the cylindrical end portion of the second channel.

5. The heat exchange device according to claim 4, wherein the first connecting port and the second connecting port are stepped holes, the first connecting port comprises a small-diameter portion close to the second connecting block and a large-diameter portion away from the second connecting block, and the inner diameter or equivalent inner diameter of the cylindrical end portion of the first channel is greater than or equal to that of the small-diameter portion of the first connecting port; and the second connecting port comprises a small-diameter portion close to the second connecting block and a large-diameter portion away from the second connecting block, and the inner diameter or equivalent inner diameter of the cylindrical end portion of the second channel is greater than or equal to the small-diameter portion of the second connecting port.

6. The heat exchange device according to claim 1, wherein the heat exchange device further comprises a mounting plate, the housing is opened at one side, the mounting plate is configured to cover the open side of the housing and is fixedly mounted to the housing, the connecting block is fixedly mounted to the mounting plate, the mounting plate is provided with second insertion holes corresponding to the first insertion holes, the at least one flat tube is mounted to the first insertion holes and the second insertion holes in a sealed manner by welding, and a depth of each of the second insertion holes is greater than or equal to 2 mm; and a sealing member is further arranged between the mounting plate and the housing, a portion of the mounting plate that is in contact with the housing is provided with a sealing member groove configured for mounting the sealing member, and the mounting plate is further provided with mounting holes for mounting the heat exchange device.

7. The heat exchange device according to claim 1, wherein the housing is opened at one side, the connecting block is configured to cover the open side of the housing and is fixedly mounted to the housing, and the at least one flat tube is mounted to the first insertion holes in a seal manner by welding; and a sealing member is further arranged between the connecting block and the housing, a portion of the connecting block that is in contact with the housing is provided with a sealing member groove configured for mounting the sealing member, and the connecting block is further provided with mounting holes for mounting the heat exchange device.

8. The heat exchange device according to claim 6, wherein an outwardly extending portion is provided at the open side of the housing, the outwardly extending portion is provided with a plurality of screw holes at positions corresponding to the mounting plate, the mounting plate is provided with a plurality of screw holes cooperating with the screw holes of the outwardly extending portion at positions corresponding to the outwardly extending portion, and the outwardly extending portion is fixedly mounted to the mounting plate by screws.

9. The heat exchange device according to claim 1, wherein the housing comprises an outer housing and a partition member, and the partition member is arranged in the outer housing, to allow a first chamber, a second chamber and a third chamber to be formed in the housing;

the partition member comprises a first partition wall, a first wall portion and a second wall portion, the first wall portion is located between the first chamber and the third chamber, the second wall portion is located between the second chamber and the third chamber, and the first partition wall is located between the first chamber and the second chamber; and the first wall portion is provided with a first communication hole, the first chamber is in communication with the third chamber through the first communication hole, the second wall portion is provided with a second communication hole, and the second chamber is in communication with the third chamber through the second communication hole.

10. The heat exchange device according to claim 9, wherein at least a part of the first fluid channel is located in the at least one flat tube, the at least one flat tube comprises a plurality of straight portions, a plurality of first bending portions and a plurality of second bending portions, and fins are arranged between the straight portions; and the first bending portions are away from the mounting plate, the second bending portions are close to the mounting plate, each of the straight portions comprises a first finless region provided with no fins which is located at an end close to the first bending portions, a first through-flow region is formed between two adjacent first finless regions, and a projection of first through-flow regions on the first wall portion partially or completely overlaps with the first communication hole.

11. The heat exchange device according to claim 10, wherein the first communication hole comprises a plurality of small communication holes having small path sizes, and a projection of each of the first through-flow regions on the first wall portion partially or completely overlaps with a corresponding small communication hole.

12. The heat exchange device according to claim 11, wherein the outer housing is an integrally formed injection molding piece or an integrally formed casting piece, the third connecting port and the fourth connecting port are integrally formed with the outer housing, the third connecting port is in communication with the first chamber, and the fourth connecting port is in communication with the second chamber; a projection of the third connecting port on the first wall portion does not interfere with the first communication hole, and a projection of the fourth connecting port on the second wall portion does not interfere with the second communication hole.

13. The heat exchange device according to claim 9, wherein the partition member further comprises a second partition wall, the first chamber is divided into two sub-chambers by the second partition wall, that is, a first sub-chamber and a second sub-chamber, and the first communication hole is also divided into two sub-communication holes by the second partition wall, that is, a first sub-communication hole and a second sub-communication hole; and the housing is further provided with the third connecting port and the fourth connecting port, the third connecting port and the fourth connecting port are integrally formed with the housing, the third connecting port is in communication with the first sub-chamber, the fourth connecting port is in communication with the second sub-chamber; a projection of the third connecting port on the first wall portion does not interfere with the first sub-communication hole corresponding to the first sub-chamber, and a projection of the fourth connecting port on the second wall portion does not interfere with the second sub-communication hole of the second sub-chamber.

14. The heat exchange device according to claim 10, wherein the partition member further comprises a second partition wall, the first chamber is divided into two sub-chambers by the second partition wall, that is, a first sub-chamber and a second sub-chamber, and the first communication hole is also divided into two sub-communication holes by the second partition wall, that is, a first sub-communication hole and a second sub-communication hole; and the housing is further provided with the third connecting port and the fourth connecting port, the third connecting port and the fourth connecting port are integrally formed with the housing, the third connecting port is in communication with the first sub-chamber, the fourth connecting port is in communication with the second sub-chamber; a projection of the third connecting port on the first wall portion does not interfere with the first sub-communication hole corresponding to the first sub-chamber, and a projection of the fourth connecting port on the second wall portion does not interfere with the second sub-communication hole of the second sub-chamber.

15. The heat exchange device according to claim 11, wherein the partition member further comprises a second partition wall, the first chamber is divided into two sub-chambers by the second partition wall, that is, a first sub-chamber and a second sub-chamber, and the first communication hole is also divided into two sub-communication holes by the second partition wall, that is, a first sub-communication hole and a second sub-communication hole; and the housing is further provided with the third connecting port and the fourth connecting port, the third connecting port and the fourth connecting port are integrally formed with the housing, the third connecting port is in communication with the first sub-chamber, the fourth connecting port is in communication with the second sub-chamber; a projection of the third connecting port on the first wall portion does not interfere with the first sub-communication hole corresponding to the first sub-chamber, and a projection of the fourth connecting port on the second wall portion does not interfere with the second sub-communication hole of the second sub-chamber.

16. The heat exchange device according to claim 12, wherein the partition member further comprises a second partition wall, the first chamber is divided into two sub-chambers by the second partition wall, that is, a first sub-chamber and a second sub-chamber, and the first communication hole is also divided into two sub-communication holes by the second partition wall, that is, a first sub-communication hole and a second sub-communication hole; and the housing is further provided with the third connecting port and the fourth connecting port, the third connecting port and the fourth connecting port are integrally formed with the housing, the third connecting port is in communication with the first sub-chamber, the fourth connecting port is in communication with the second sub-chamber; a projection of the third connecting port on the first wall portion does not interfere with the first sub-communication hole corresponding to the first sub-chamber, and a projection of the fourth connecting port on the second wall portion does not interfere with the second sub-communication hole of the second sub-chamber.

* * * * *